US008931571B2

(12) United States Patent
Sarkisyan et al.

(10) Patent No.: US 8,931,571 B2
(45) Date of Patent: Jan. 13, 2015

(54) FIRE SPRINKLER EXTENSION AND HEAD ADAPTOR

(76) Inventors: Saro Sarkisyan, Glendale, CA (US); Armond Sarkisyan, Glendale, CA (US)

( * ) Notice: Subject to any disclaimer, the term of this patent is extended or adjusted under 35 U.S.C. 154(b) by 1122 days.

(21) Appl. No.: 12/724,167

(22) Filed: Mar. 15, 2010

(65) Prior Publication Data

US 2010/0252282 A1 Oct. 7, 2010

Related U.S. Application Data

(60) Provisional application No. 61/211,742, filed on Apr. 2, 2009.

(51) Int. Cl.
*A62C 37/08* (2006.01)
*A62C 35/68* (2006.01)

(52) U.S. Cl.
CPC ..... *A62C 35/68* (2013.01)
USPC ..... 169/37; 169/41; 239/203; 239/209; 285/32

(58) Field of Classification Search
CPC ..... A62C 35/68; A62C 31/0066
USPC ..... 169/17, 37, 41; 239/209, 203; 285/32, 285/21.1
See application file for complete search history.

(56) References Cited

U.S. PATENT DOCUMENTS

| | | | | | |
|---|---|---|---|---|---|
| 3,451,483 | A * | 6/1969 | Van Houtte et al. | ..... | 169/37 |
| 4,220,208 | A * | 9/1980 | Jackson et al. | ..... | 169/17 |
| 4,366,866 | A * | 1/1983 | Sweeney | ..... | 169/37 |
| 5,335,857 | A * | 8/1994 | Hagon | ..... | 239/204 |

* cited by examiner

*Primary Examiner* — Dinh Q Nguyen
(74) *Attorney, Agent, or Firm* — Law Offices of Kamran Fattahi

(57) ABSTRACT

The present invention is embodied in a sprinkler head adaptor assembly including a sprinkler head adaptor having a generally cylindrical shape and a female threaded interior wall in a central aperture for receiving a male threaded sprinkler head. The sprinkler head adaptor includes an exterior surface that includes an exposed portion. The assembly includes a pipe extension formed from an injection moldable material with a length suitable for spanning a distance from a pipe system to sprinkler location that is formed integrally with the sprinkler head adaptor, wherein the exposed portion of sprinkler head adaptor is sized and shaped for engagement with a wrench. A metal ring maybe formed in the central aperture.

20 Claims, 5 Drawing Sheets

FIRE SPRINKLER EXTENSION AND HEAD ADAPTOR

CROSS-REFERENCE TO RELATED APPLICATION(S)

This application claims the benefit of U.S. Provisional Application Ser. No. 61/211,742, filed on Apr. 2, 2009, the contents of which are all hereby incorporated by reference.

BACKGROUND OF THE INVENTION

1. Field of the Invention

This invention relates to fire sprinkler systems used in commercial or residential buildings and, more particularly, to an improved sprinkler head adaptor.

2. Description of the Related Art

In all sorts of commercial or residential buildings and structures, fire sprinkler systems are designed and installed to provide a degree of safety and protection to the occupants as well as to the building and its contents in the event of a fire. In certain applications, fire sprinkler systems are also required to be installed by law or other building codes or regulations.

Typically, a fire sprinkler system includes a series of interconnected pipes that are placed overhead in the ceiling where the pipes are connected to a source of water and the water can flow through the pipes when the system is tripped in the event of a fire. The water source can come from water that is provided to the building from the city's main water pipes. A series of sprinkler heads connected to the pipe system and strategically placed throughout the ceiling area of the building allow water to spray out in the event of fire. In this manner, when fire occurs and the fire sprinkler system is activated, water is sprayed from the sprinkler heads in the ceiling areas and onto the occupants and other contents of the building so as to extinguish the fire or to contain or slow down the spread of fire until additional help can be provided by fire fighting units.

Currently, in typical fire sprinkler system installations, the interconnected pipes that carry the water to sprinkler heads are made of suitable fire-safe material, such as CPVC (Chlorinated polyvinyl chloride), that has been approved by applicable building and inspection codes. For the most part, these interconnected pipes are placed in a horizontal plane in the ceiling area, and in certain parts of the building they may need to run in other directions to navigate the building as appropriate. Wherever a sprinkler head is needed, a T-shaped connector that is typically made of the same CPVC material as the main pipes is fitted and connected on two of its in-line ends onto the main pipe by use of liquid glue there between to form a leak-proof connection. The third branch of the T-connector that is usually perpendicular to the two in-line branches is positioned so that it's opening faces downward.

Specifically, in existing systems, the sprinkler head usually needs to be positioned several inches or more below the level of the main pipe system in the ceiling, and for that purpose a separate piece of pipe extension is first connected to the third branch of the T-connector that is facing down, and then the sprinkler head is connected to that pipe extension. More specifically, the pipe extension is connected to the T-connector by applying suitable liquid glue around the upper end and rim of the pipe extension and inside the T-connector so that the two joined pieces form a solid and permanent leak-proof connection. At the lower end of the pipe extension, a CPVC sprinkler head adaptor is then fitted over and connected to the lower end of the pipe extension by applying glue between the upper end or rim of the adaptor and the lower end or rim of the pipe extension. The lower end of the sprinkler head adaptor is provided with female threads. The female threaded end of the sprinkler head adaptor can be injection molded as part of the same CPVC plastic material that is used for the remainder of the adaptor. Alternatively, in existing designs, a brass nut with female threads is placed at the lower end of the CPVC sprinkler head adaptor during the injection molding process of the adaptor. Regardless of whether the lower female threaded end of the head adaptor is made of CPVC material or is made of a brass nut, a fire sprinkler head that has a male threaded brass connector at its end opposite the sprinkler end is threaded inside the female threaded connector of the CPVC adaptor.

These existing systems of installation have certain disadvantages and drawbacks. For example, whenever the brass male threads of a sprinkler head are threaded inside the plastic injection molded female threads of a connector or adapter, the plastic female threads are susceptible to cracking and breakage due to the pressure created by the brass male threads of the sprinkler head.

In addition, in situations where the pipe extension is used to install the sprinkler head some distance below the horizontal plane of the main water carrying pipes, several problems are encountered. For example, because liquid glue is used to connect the lower end of the pipe extension to the plastic sprinkler head adaptor, often times the liquid glue oozes or seeps out of the connection, which is messy. The liquid glue can also run inside the head adaptor, which may block or restrict the flow of water to the sprinkler head. Another problem is that the installation of a plastic sprinkler head adaptor by gluing it to the lower end of the pipe extension takes too much time, material, and labor.

In view of the foregoing, a fire sprinkler extension and head adaptor design is needed that is less expensive, requires less time to install, and provides for a more secure connection between the various pieces. The present invention fulfills these and other needs.

SUMMARY OF THE INVENTION

The present invention is embodied in a sprinkler head adaptor assembly including a sprinkler head adaptor having a generally cylindrical shape and a female threaded interior wall in a central aperture for receiving a male threaded sprinkler head. The sprinkler head adaptor includes an exterior surface that includes an exposed portion. The assembly includes a pipe extension formed from an injection moldable material with a length suitable for spanning a distance from a pipe system to sprinkler location that is formed integrally with the sprinkler head adaptor, wherein the exposed portion of sprinkler head adaptor is sized and shaped for engagement with a wrench.

In one embodiment, the sprinkler head adaptor is of a non-corrosive metal, such as brass.

In one embodiment of the assembly, the exterior surface includes a pipe-engaging portion wherein a portion of the pipe extension surrounds the pipe-engaging portion.

In one embodiment of the assembly, the pipe includes a head adaptor segment surrounding the pipe-engaging portion for added support.

In one embodiment of the assembly, the pipe includes a neck region between the head adaptor segment and the exposed portion.

In one embodiment of the assembly, the exposed portion is formed from an injection moldable material.

In one embodiment of the assembly, the sprinkler head adapter at an opening of the central aperture a metal ring is disposed.

In one embodiment of the assembly, the pipe extension includes a female connector for connection to anther pipe segment.

BRIEF DESCRIPTION OF THE DRAWINGS

Other aspects, advantages and novel features of the invention will become more apparent from the following detailed description of the invention when considered in conjunction with the accompanying drawings wherein.

DESCRIPTION OF PREFERRED EMBODIMENT

Figure 1A:
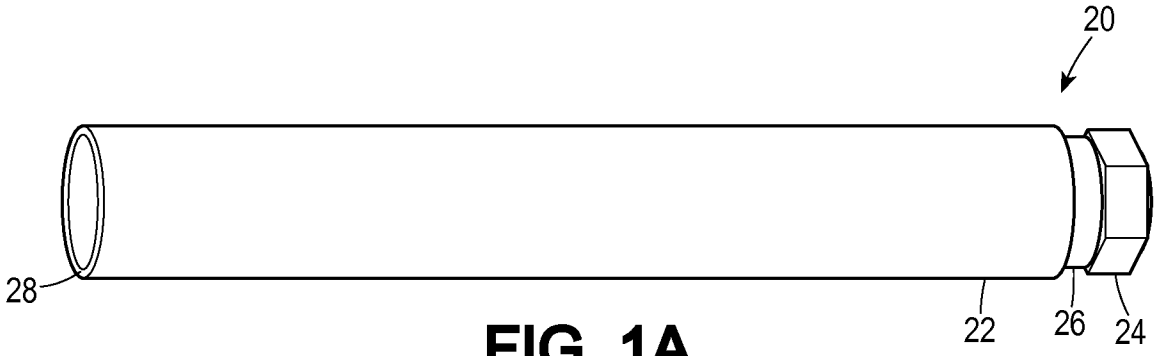
FIG. 1A is a perspective view of an embodiment of a sprinkler head adaptor according to the present invention.
Figure 1B:
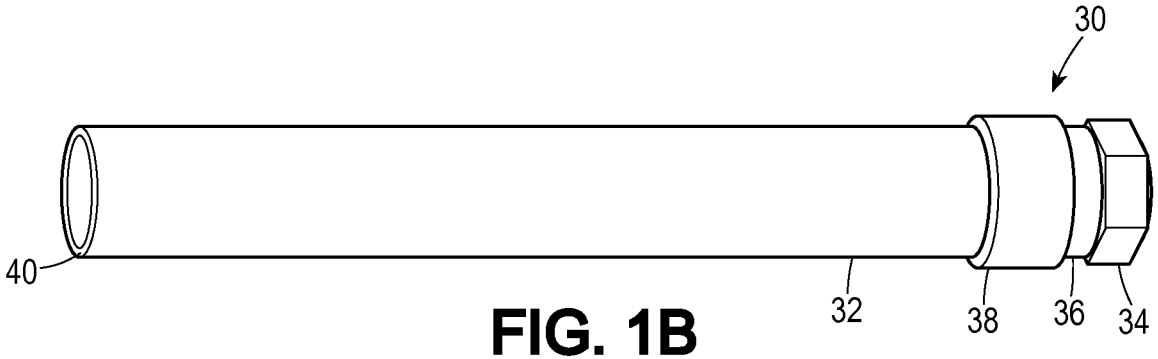
FIG. 1B is a perspective view of an embodiment of a sprinkler head adaptor according to the present invention.

As shown in exemplary FIGS. 1 through 9, the fire sprinkler extension and head adaptor of the present invention are shown and described as follows:

With reference to FIGS. 1A and 1B, typically sprinkler piping systems utilize pipe of two different diameter sizes that is typically connected between a sprinkler head and to a sprinkler system, wherein FIG. 1A refers to 1.0 inch diameter pipe and FIG. 1B refers to 0.75 inch diameter pipe. While these pipe diameters are disclosed as being related to the typical diameters found in sprinkler systems, other diameter pipe may be employed without departing from the present invention.

With reference to FIG. 1A, a pipe extension and head adaptor 20 includes a 1.0 inch diameter pipe 22 wherein advantageously in this invention a female brass fitting 24 that can accept and be connected to a sprinkler head forms an integral part of the pipe extension 22 and a glued connection between the head adaptor and the lower end of the pipe extension is avoided. Preferably, this integrally form connection between the pipe extension and the brass fitting is made during the injection mold process when the pipe extension is formed. In situations where the pipe extension has a larger diameter (e.g., 1.0 inch diameter as shown in the pipe extension of FIG. 1A), no special accommodation is required to secure the brass fitting to the pipe. A neck region 26 may be formed between the pipe wall diameter and the exposed brass nut. This region services to cover the brass fitting with excess CPVC from the injection mold process with providing a thinner diameter region to facilitate grasping of the brass fitting with a wrench. While the brass fitting may be sized to fit any size wrench independent of the internal threaded diameter (not shown), which could avoid the neck region 26, present commercial installations typically use a wrench that fits a 1.0 inch size nut for the brass fitting where the nut has a 0.5 inch inner diameter. Typically a 1.0-inch diameter pipe will include a wall thickness 28 of generally 0.112 inches.

With reference to FIG. 1B, a pipe extension and head adaptor 30 includes a 0.75-inch diameter pipe 32 wherein advantageously in this invention a female brass fitting 34 that can accept and be connected to a sprinkler head forms an integral part of the pipe extension 32 and a glued connection between the head adaptor and the lower end of the pipe extension is avoided. The brass fitting 34 is presently dimensioned similar to brass fitting 26 with a 1.0 inch outer diameter and 0.5 inch inner diameter. More specifically, in situations where the pipe extension has a narrower diameter (e.g., 0.75 inch diameter as shown in the pipe extension of FIG. 1B), a neck region 36 is positioned between the exposed brass fitting and a head adaptor segment 38 that is utilized at the lower end of the pipe extension, where the pipe extension and the head adaptor are integrally formed in one injection molding process. It will be appreciated by those skilled in the art that by making minor adjustments to the injection mold shape of the pipe extension that the same brass fitting by be used to thereby reducing manufacturing costs for providing pipe extensions and head adaptors of different diameters. Typically a 0.75-inch diameter pipe will include a wall thickness 28 of generally 0.101 inches.

Regardless of pipe extension diameter size, a female threaded brass nut fitting is positioned at the lower end of the pipe extension, and a glued joint between the lower rim of the pipe extension and the head adaptor is avoided.

In an alternatively preferred embodiment the pipe extension is included with indicia (not shown) at locations along the length of the outer wall of the pipe to indicate cut points to allow for the pipe extension to be cut to a length extending from the T-connector to the sprinkler spaced apart and below the T-connector. This avoid the hassle of having to measure each extension before cutting it.

Figure 2:
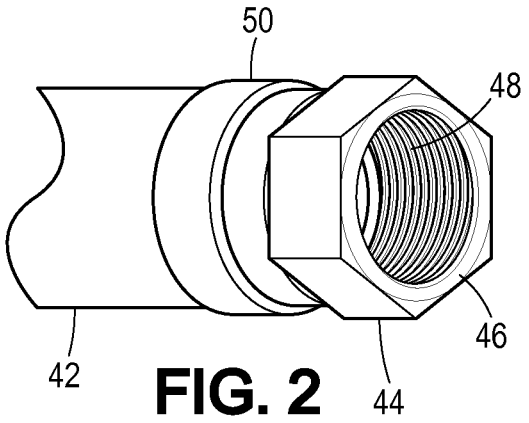
FIG. 2 is a perspective partial view of an embodiment of a sprinkler head adaptor according to the present invention.

With reference to FIG. 2, a CPVC pipe extension 42 with an integrally formed sprinkler head adaptor that has been injection molded with a wrench connect region 44, wherein according to one aspect of the present invention a brass ring 46 is fixed at a lower end of a female threaded portion 48. By using a brass ring at the lower end of the plastic female threads that would cause the brass threads of the sprinkler head to first come in contact with the brass ring, the problem of cracking or breakage of the plastic threads is avoided or minimized. The pipe includes a raised segment 50 that provides for reinforcement for the pipe to receive a metal male threaded portion of the sprinkler head (not shown). While this segment 50 appears similar to the head adaptor segment 38 of FIG. 1A, this segment serves a different function while allowing for the same injection mold to be utilized for both embodiments.

Figure 3:
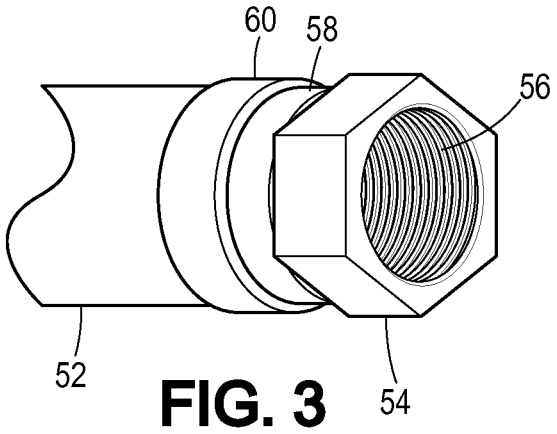
FIG. 3 is a perspective partial view of the embodiment of a sprinkler head adaptor according to FIG. 1B.

With reference to FIG. 3, a CPVC pipe extension 52 similar to FIG. 1B with an integrally formed brass sprinkler head adaptor that has been injection molded having a wrench connect region 54 surrounding a female threaded portion 56. The pipe includes a neck region 58 and a head adaptor segment 60 that functions as described in relation to like structures in FIG. 1B.

Figure 4:
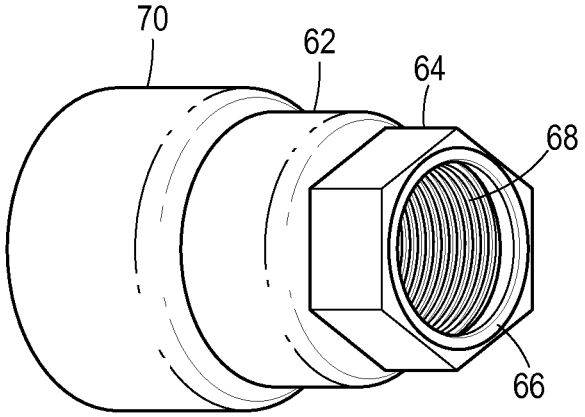
FIG. 4 is a perspective view of an alternate embodiment of a sprinkler head adaptor according to the present invention.

With reference to FIG. 4, a CPVC sprinkler head adaptor 62 that has been injection molded with a wrench connect region 64, wherein according to one aspect of the present invention a brass ring 66 is fixed at a lower end of a female threaded portion 68. A female pipe connector 70 is formed at a free end for direct connection to a T-connector or other pipe extension (not shown).

Figure 5:
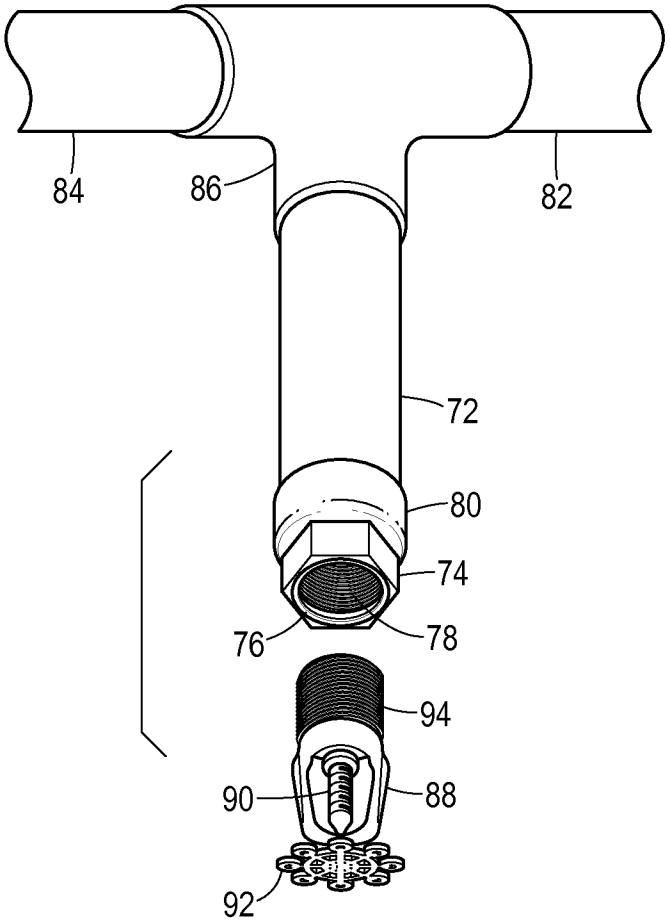
FIG. 5 is a partially exploded, perspective view of an embodiment of a sprinkler head adaptor according to the present invention in a sprinkler system.

With reference to FIG. 5, a CPVC pipe extension 72 with an integrally formed sprinkler head adaptor that has been injection molded with a wrench connect region 74, wherein according to one aspect of the present invention a brass ring 76 is fixed at a lower end of a female threaded portion 78. By using a brass ring at the lower end of the plastic female threads that would cause the brass threads of the sprinkler head to first come in contact with the brass ring, the problem of cracking or breakage of the plastic threads is avoided or minimized. The pipe includes a raised segment 80 that provides for reinforcement for the pipe to receive a metal male threaded portion of the sprinkler head. When installed in a sprinkler system, segments 82 and 84 of the main pipe that carries the water and is positioned in a horizontal plane in the ceiling area (ceiling area not shown) and a T-connector 86 connects the main pipe segments 82 and 84 to the pipe extension 72 connected to the lower perpendicular branch of the T-connector 86. With the pipe extension having an integrally formed head adaptor portion, a sprinkler head 88 having thermally activated flow tube 90 and spray nozzle 92 that connects to the head adaptor via a threaded male segment 94. A sprinkler head of the type suitable for this purpose is any having a threaded pipe suitable for insertion in the threaded portion of the head adaptor.

Figure 6:
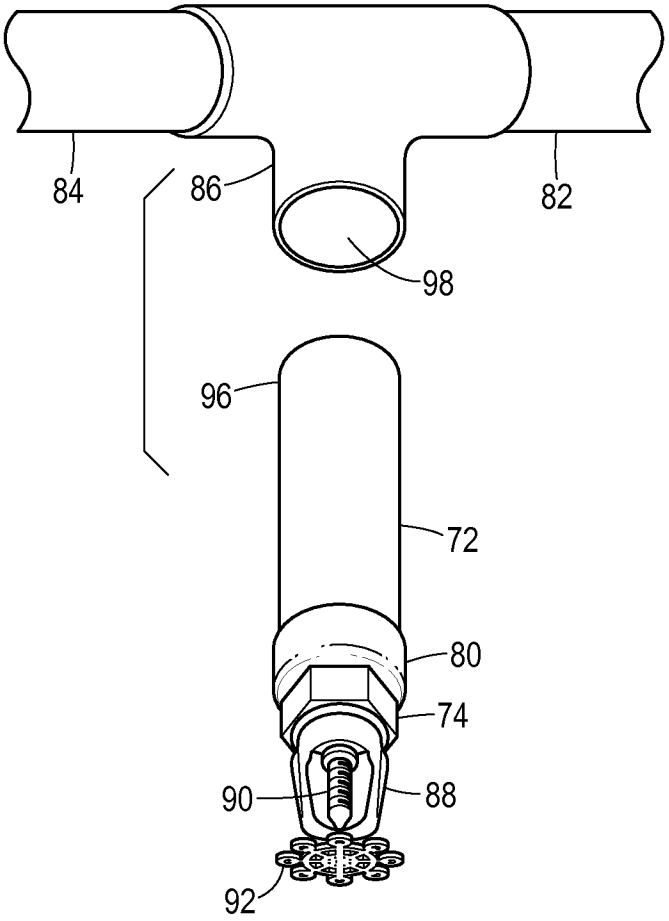
FIG. 6 is a partially exploded, perspective view of an embodiment of a sprinkler head adaptor according to the present invention in a sprinkler system.

FIG. 6 is similar to FIG. 5, except that the pipe extension 72 has not yet been connected to the T-connector 86 lower portion 98, but the sprinkler head 88 has been connected to the integrally formed head adaptor 74 and the pipe extension 72.

It will be appreciated by those skilled in the art that the final step of assembling the sprinkler head to the sprinkler system may include the attachment of the sprinkler head to the sprinkler head adapter as shown in FIG. 5 or attachment of the pipe extension to the sprinkler system as shown in FIG. 6.

Figure 7:
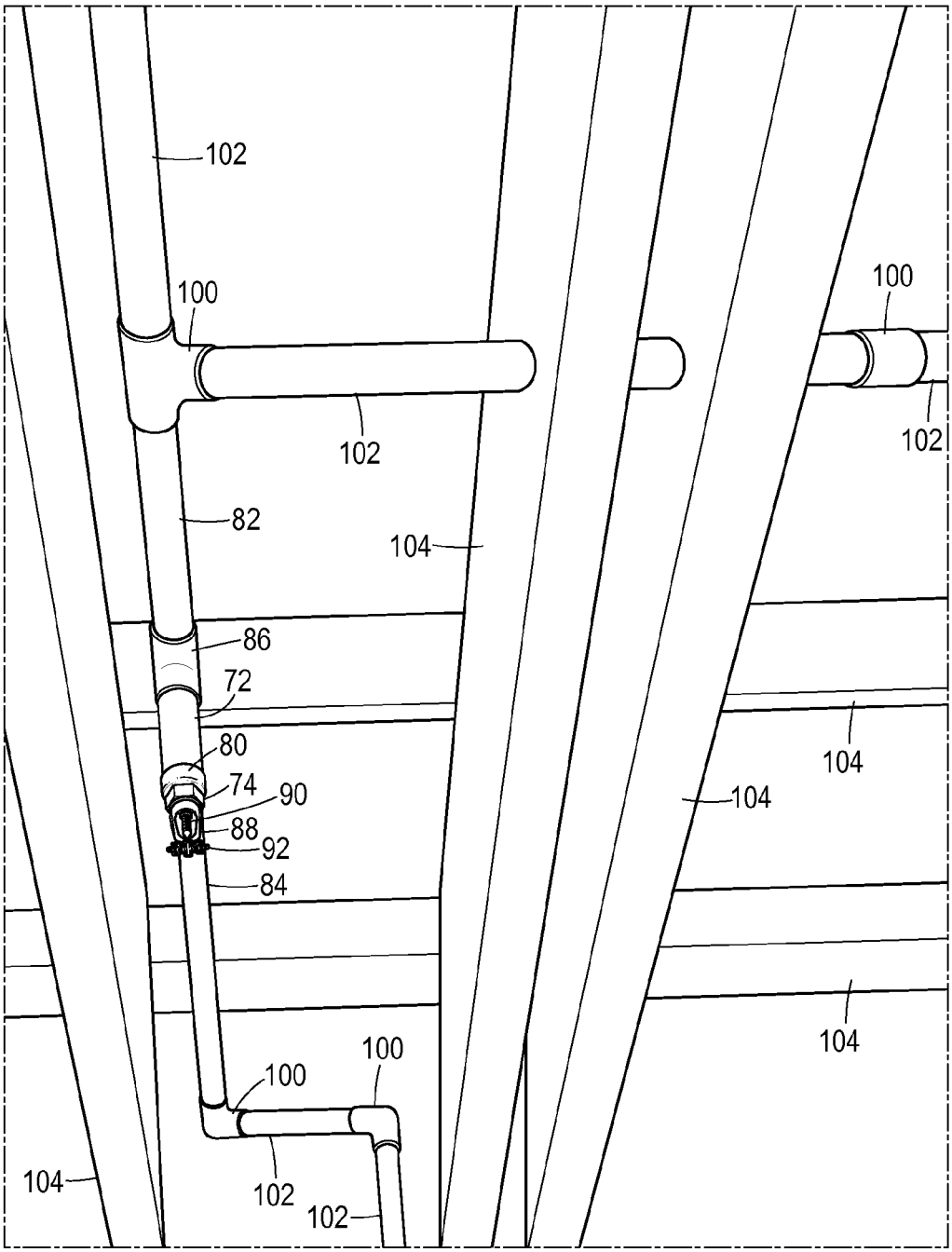
FIG. 7 is an environmental, perspective view of an embodiment of a sprinkler head adaptor according to the present invention in a sprinkler system.

With reference to FIG. 7, the fire sprinkler system of FIGS. 5 and 6 according to the present invention is installed in a pipe system having pipe fittings 100 and pipe segments 102 that through beams 104 in the ceiling area of a building or structure.

Figure 8:
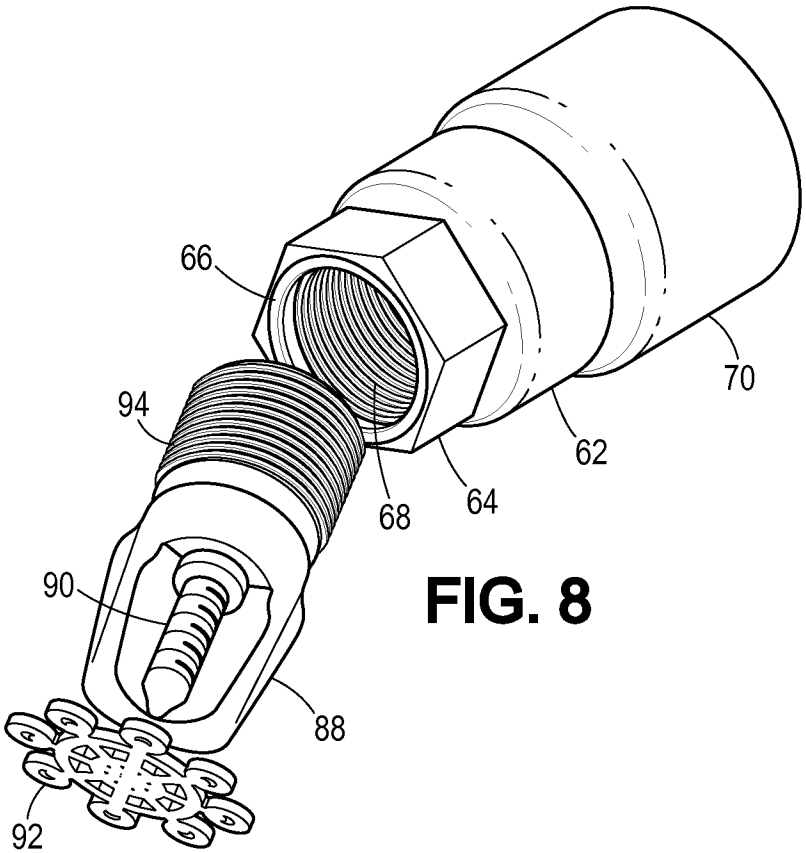
FIG. 8 is a partially exploded, perspective view of an embodiment of a sprinkler head adaptor according to the present invention with a sprinkler head.

With reference to FIG. 8, a sprinkler head of the type illustrated in FIG. 4 is in the form a CPVC sprinkler head adaptor 62 that has been injection molded with a wrench connect region 64, wherein according to one aspect of the present invention a brass ring 66 is fixed at a lower end of a female threaded portion 68. A female pipe connector 70 is formed at a free end for direct connection to a T-connector or other pipe extension (not shown). The female thread portion connects to a sprinkler head 88 having thermally activated flow tube 90 and spray nozzle 92 that connects to the head adaptor via a threaded male segment 94.

Figure 9:
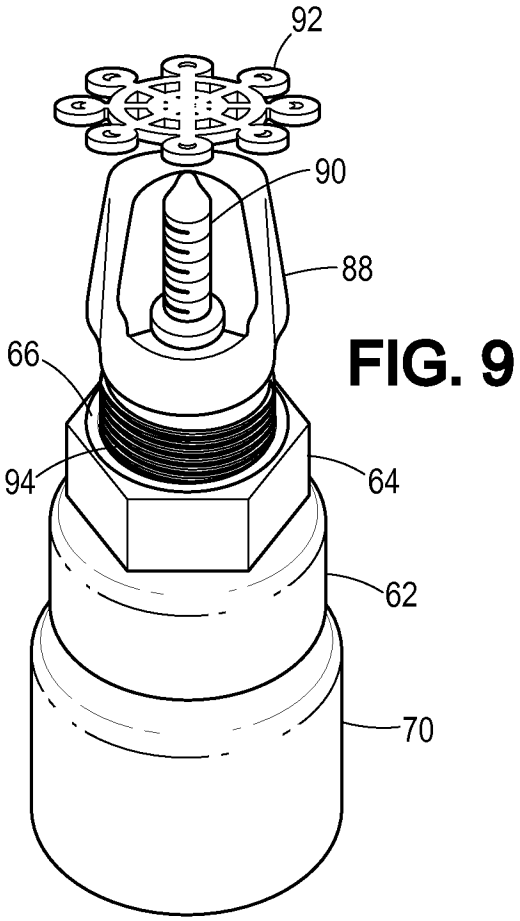
FIG. 9 is a perspective view of an embodiment of a sprinkler head adaptor according to the present invention with a sprinkler head.

With reference to FIG. 9, the sprinkler head is connected to the sprinkler head adaptor of FIG. 8.

With the present invention, fire sprinkler systems can be relatively inexpensive to manufacture, and they can be installed in an easier and quicker fashion than before. For example, when the head adaptor is integrally formed in the lower end of the pipe extension (see FIGS. 1-4), there is no need for glue in that region, and the problems outlined above in existing designs that have a glued connection or joint at the lower end of the pipe extension are avoided. Moreover, by using pipe extensions of appropriate length, when the pipe extension is connected to the T-connector, without the need to glue the lower end of the pipe extension to the head adaptor, the system can be more easily and quickly installed, and the female threaded brass nut at the bottom end of the pipe extension can be quickly capped and closed to allow the whole piping system to be pressurized and tested to make sure that there is not water leakage anywhere.

Also, in another aspect of the present invention (see FIGS. 4, 8 and 9), for sprinkler head adaptors which include plastic female threads (not a female threaded brass nut), by utilizing a brass ring at the lower end of the plastic female threads that would cause the brass threads of the sprinkler head to first come in contact with the brass ring, the problem of cracking or breakage of the plastic threads is avoided or minimized.

Thus it will be appreciated that the present invention is embodied in a sprinkler head adaptor assembly including a sprinkler head adaptor having a generally cylindrical shape and a female threaded interior wall in a central aperture for receiving a male threaded sprinkler head. The sprinkler head adaptor includes an exterior surface that includes an exposed portion. The assembly includes a pipe extension formed from an injection moldable material that is formed integrally with the sprinkler head adaptor, wherein the exposed portion of sprinkler head adaptor is sized and shaped for engagement with a wrench.

In one embodiment, the sprinkler head adaptor is of a non-corrosive metal, such as brass.

In one embodiment of the assembly, the exterior surface includes a pipe-engaging portion wherein a portion of the pipe extension surrounds the pipe-engaging portion.

In one embodiment of the assembly, the pipe includes a head adaptor segment surrounding the pipe-engaging portion for added support.

In one embodiment of the assembly, the pipe includes a neck region between the head adaptor segment and the exposed portion.

In one embodiment of the assembly, the exposed portion is formed from an injection moldable material.

In one embodiment of the assembly, the sprinkler head adapter at an opening of the central aperture a metal ring is disposed.

In one embodiment of the assembly, the pipe extension includes a female connector for connection to anther pipe segment.

It is to be noted that the present invention can be made in a variety of sizes and diameters to accommodate many different applications. A variety of further modifications and alternatives in and to the invention will be apparent to persons skilled in the art without departing from the scope and spirit of the invention.

What is claimed is:

1. A sprinkler head adaptor assembly comprising:

a sprinkler head adaptor having a generally cylindrical shape and a female threaded interior wall in a central aperture for receiving a male threaded sprinkler head;

said sprinkler head adaptor includes an exterior surface including a hexagon-shaped exposed portion sized and shaped for engagement with a wrench;

a pipe extension formed from an injection moldable material with a length suitable for spanning a distance from a pipe system to sprinkler location and formed integrally in one-piece molding with said sprinkler head adaptor; and a reinforcing raised segment having an outside diameter larger than said pipe extension and being formed from an injection moldable material being positioned between and formed integrally in one-piece molding with said sprinkler head adaptor and said pipe extension.

2. The assembly of claim 1 wherein:

said exterior surface includes a pipe engaging portion; and a portion of said pipe extension surrounds said pipe engaging portion.

3. The assembly of claim 2 wherein said sprinkler head adaptor is a non-corrosive metal.

4. The assembly of claim 3 wherein said sprinkler head adaptor is brass.

5. The assembly of claim 2 wherein said pipe includes a head adaptor segment surrounding said pipe engaging portion for added support.

6. The assembly of claim 5 wherein said pipe includes a neck region between said head adaptor segment and said exposed portion.

7. The assembly of claim 1 wherein said exposed portion is formed from an injection moldable material.

8. The assembly of claim 7 wherein at an opening of said central aperture a metal ring is disposed.

9. The assembly of claim 8 wherein said metal ring is a non-corrosive metal.

10. The assembly of claim 9 wherein said metal ring is brass.

11. The assembly of claim 8 wherein said interior wall is formed from an injection moldable material.

12. The assembly of claim 1 wherein said injection moldable material is fire resistant.

13. The assembly of claim 1 wherein said injection moldable material is CPVC.

14. The assembly of claim 1 wherein said pipe extension includes indicia indicating locations for cutting said pipe extension to lengths corresponding to said locations.

15. A sprinkler head adaptor assembly comprising:

a sprinkler head adaptor having a generally cylindrical shape and a female threaded interior wall in a central aperture for receiving a male threaded sprinkler head;

said sprinkler head adaptor includes an exterior surface including a hexagon-shaped exposed portion sized for engagement with a wrench;

said exposed portion is formed from an injection moldable material and formed integrally in one-piece molding with said sprinkler head adaptor;

a reinforcing raised segment formed from an injection moldable material being positioned between and formed integrally in one-piece molding with said sprinkler head adaptor and said exposed portion; and at an opening of said central aperture a metal ring is disposed.

16. The assembly of claim 15 wherein said injection moldable material is CPVC.

17. The assembly of claim 16 wherein said metal ring is brass and said interior wall is formed from an injection moldable material.

18. An apparatus, comprising:

a cylindrically shaped sprinkler head adaptor formed from an injection moldable material having a central aperture formed with a female threaded interior wall, the sprinkler head adaptor further including a wrench connect region being hexagon-shaped and sized for engagement with a wrench;

a pipe extension formed from an injection moldable material and formed integrally in one-piece molding with the sprinkler head adaptor; and a reinforcing raised segment having an outside diameter larger than the pipe extension and being formed from an injection moldable material being positioned between and formed integrally in one-piece molding with the sprinkler head adaptor and the pipe extension.

19. The apparatus of claim 18, wherein the wrench connect region is formed from an injection moldable material and formed integrally in one-piece molding with the sprinkler head adaptor.

20. The apparatus of claim 19, further comprising a brass ring disposed in an opening formed in the central aperture of the sprinkler head adaptor.

* * * * *